US009725259B2

(12) United States Patent
Plotzitzka et al.

(10) Patent No.: US 9,725,259 B2
(45) Date of Patent: Aug. 8, 2017

(54) METHOD FOR FEEDING NOTES OF VALUE TO AN AUTOMATED TELLER MACHINE

(71) Applicant: WINCOR NIXDORF INTERNATIONAL GmbH, Paderborn (DE)

(72) Inventors: Joerg Plotzitzka, Rietberg (DE); Elmar Berendes, Warburg (DE); Karl-Heinz Seroka, Salzkotten (DE); Florante Go, Singapur (SG); Ralf Welter, Paderborn (DE); ChiaWei Hee, Singapur (SG)

(73) Assignee: WINCOR NIXDORF INTERNATIONAL GMBH, Paderborn (DE)

( * ) Notice: Subject to any disclaimer, the term of this patent is extended or adjusted under 35 U.S.C. 154(b) by 0 days.

(21) Appl. No.: 14/805,698

(22) Filed: Jul. 22, 2015

(65) Prior Publication Data

US 2016/0023854 A1 Jan. 28, 2016

(30) Foreign Application Priority Data

Jul. 24, 2014 (EP) ..... 14178263

(51) Int. Cl.

| | |
|---|---|
| ***B65H 1/00*** | (2006.01) |
| ***B65H 1/02*** | (2006.01) |
| ***B65H 1/26*** | (2006.01) |
| ***B65H 1/30*** | (2006.01) |
| *G07D 11/00* | (2006.01) |

(52) U.S. Cl.

CPC ..... *B65H 1/027* (2013.01); *B65H 1/266* (2013.01); *B65H 1/30* (2013.01); *G07D 11/0006* (2013.01); *G07D 11/0012* (2013.01)

(58) Field of Classification Search

CPC ..... B65H 1/266; B65H 1/30; B65H 1/027; G07D 11/0006; G07D 11/0012

See application file for complete search history.

(56) References Cited

U.S. PATENT DOCUMENTS

| | | | | |
|---|---|---|---|---|
| 7,559,183 | B2 * | 7/2009 | Bell | B65B 25/141 206/499 |
| 8,479,979 | B2 * | 7/2013 | Leeper | G07D 11/0012 235/375 |
| 8,550,453 | B2 * | 10/2013 | Cost | G07D 11/0006 271/149 |
| 8,567,773 | B2 | 10/2013 | Berendes | |

(Continued)

FOREIGN PATENT DOCUMENTS

| | | |
|---|---|---|
| DE | 10 2009 017 220 | 10/2010 |
| DE | 10 2009 037 459 | 2/2011 |
| EP | 1 553 531 | 7/2005 |

OTHER PUBLICATIONS

European Search Report of Jan. 29, 2015.

*Primary Examiner* — Jeremy R Severson

(74) *Attorney, Agent, or Firm* — Gerald E. Hespos; Michael J. Porco; Matthew T. Hespos

(57) ABSTRACT

A method for feeding notes of value (20) to a device for handling notes of value includes manually filing a cash cassette (10) with the notes of value (20), and rotating the cash cassette (10) so that the side that was arranged at the bottom during the filling of the cash cassette (10), is arranged at the top. The cash cassette (10) then is inserted into the device for handling notes of value in this rotated orientation.

14 Claims, 2 Drawing Sheets

(56) References Cited

U.S. PATENT DOCUMENTS

| | | | | |
|---|---|---|---|---|
| 8,887,986 | B2 * | 11/2014 | Berendes | G07D 11/0009 109/45 |
| 9,221,632 | B2 * | 12/2015 | Arthur | B65H 1/266 |
| 2007/0013124 | A1 | 1/2007 | Graef et al. | |
| 2011/0202173 | A1 * | 8/2011 | Doi | G07D 11/0051 700/219 |
| 2012/0032391 | A1 | 2/2012 | Holland-Letz et al. | |
| 2012/0199507 | A1 | 8/2012 | Berendes | |
| 2012/0323361 | A1 * | 12/2012 | Brexel | G07D 11/0009 700/236 |

* cited by examiner

State of the Art

METHOD FOR FEEDING NOTES OF VALUE TO AN AUTOMATED TELLER MACHINE

BACKGROUND

1. Field of the Invention

The invention relates to a method for feeding notes of value to a device for handling notes of value, in particular to an automated teller machine or a cash register system. In this method, the notes of value are manually fed to a cash cassette via an opening for manual feeding. Subsequently, a cover of the cash cassette for closing this opening is closed and the cash cassette is inserted into an automated teller machine or another device for handling notes of value. Moreover, the invention relates to a cash cassette and a device for handling notes of value.

2. Description of the Related Art

In FIG. 1, a known cash cassette 100 of the prior art is shown. The cash cassette 100 has an opening 102 that is closable by a non-illustrated cover and via which notes of value 106 can be fed to a receiving area 104. Here, the notes of value 106 are received in the form of a value note stack and stand with one of their edges on a bottom unit 108 of the cash cassette 100. Further, the cash cassette 100 has another opening 110 for the automatic removal of notes of value. The other opening 110 being closable via a shutter 112.

As indicated by the arrow P1, the feeding of the notes of value takes place from above in vertical direction. When the cash cassette 100 is inserted in an automated teller machine, the notes of value 106 are removed downward through the opening 110 by means of a separating module, as indicated by the arrow P2. Thus, the feeding of notes of value takes place from above and the removal takes place downwards so that the feeding and removal direction P1, P2 are unidirectional.

When feeding the notes of value 106 to the receiving area 104, so-called L-folded notes of value may result, as this is exemplarily shown for the note of value 114. The note of value 114 is folded at the bottom so that adjacent notes of value 106 of the value note stack stand thereon. This folding is arranged on the side facing away from the feeding side. Thus, such L-folded notes of value cannot be detected by the operator filling up the cash cassette 100.

In the case of an automatic removal of notes of value 106 from cash cassettes 100, L-folded notes of value pose a problem because such L-folded notes of value 114 may result in that these notes of value 114 cannot be removed and thus the device goes out of service. Particularly problematic is that the adjacent notes of value 106 of the value note stack stand on the folded part of the L-folded note of value 114 and thus make its removal even more difficult. This is aggravated by the fact that the folded part is pressed upwards by the downward removal so that the adherence between the L-folded note of value 114 and the adjacent notes of value is further increased.

Such cash cassettes in which the manual feeding and the automatic removal take place in the same direction are known, for example, from DE 10 2009 037 459 A1 and U.S. Pat. No. 8,567,773 B2. Further, DE 10 2009 017 220 A1 discloses a cash cassette having three receiving compartments.

It is an object of the present invention to specify a method for feeding notes of value to a device for handling notes of value and a cash cassette, by which the occurrence of malfunctions caused by L-folded notes of value is prevented or at least minimized.

SUMMARY OF THE INVENTION

According to the invention, after the cash cassette was filled, i.e. after the notes of value were fed manually via the opening for the manual feeding, the cash cassette is rotated so that the side of the cash cassette that is arranged at the bottom during filling, is now arranged at the top. Afterwards, the cash cassette is inserted in this rotated position, i.e. upside down, into the device for handling notes of value, for example an automated teller machine, an automatic cash register system or an automatic cash safe.

By turning over the cash cassette, it is achieved that the cash cassette is received in the automated teller machine upside down so that now the notes of value stand with one of their edges on that one side that was at the top and thus visible during the manual filling so that L-folded notes of value that might occur on this side can be detected, and the L-folding can be eliminated. Thus, it cannot happen that in the turned-over position in which the cash cassette is inserted in the automated teller machine, the L-folded notes of value occur on that side on which the notes of value stand. L-folded notes of value can only be present on the side that is at the bottom during feeding of the notes of value, i.e. at the top when the cash cassette is in its inserted position. This, however, is relatively uncritical since the weight of the adjacent notes of value does not rest on these folded parts now arranged on top.

In addition, by turning over the cash cassette before it is inserted into the automated teller machine it is further achieved that the notes of value, with respect to the cash cassette itself, are—compared to the feeding direction of the manual feeding—removed in opposite direction, i.e. with respect to the position of the cash cassette in which it was arranged during the filling with notes of value upwards. This has the advantage that the L-folded notes of value can simply be moved upwards around their folded edge, which is far easier than a removal in the downward direction, as this is known from the prior art.

Altogether, it is thus achieved that by means of the possible visual check fewer L-folded notes of value occur and still occurring L-folded notes of value much more rarely result in a malfunction during the automatic removal of notes of value from the cash cassette.

In one embodiment, the cash cassette is rotated by 180° after the filling with the notes of value and before the insertion into the device for handling notes of value. The rotation about 180° takes place so that the undersides now are arranged on top and vice versa. In particular, the cash cassette will be rotated about its horizontal axis.

During the manual filling, the notes of value are fed from above in vertical direction, i.e. from top to bottom. Thus, the feeding can take place in an ergonomically favorable manner and the person feeding the notes of value can see that side that will be at the bottom, when the cash cassette is in its inserted position.

The filling of the cash cassette may take place manually in a cash center, from where the cash cassette then is transported to the device for handling notes of value. In this connection, the cash cassette can already be rotated in the cash center so that the subsequent transport takes place with an already rotated cash cassette, i.e. in that orientation in which the cash cassette is also inserted into the automated teller machine. Alternatively, the cash cassette can likewise be transported in that orientation in which it was arranged during filling and only be rotated on-site immediately before the insertion into the device for handling notes of value.

Which of these two methods is more favorable, depends on the mechanical structure of the cash cassette, depending in which transport orientation an undesired slipping of the notes of value can be prevented more reliably.

When the cash cassette is inserted into the device for handling notes of value, the notes of value may be removed automatically by a separating module of the device via another opening of the cash cassette. The removal may take place downward.

Thus, in absolute terms, the feeding direction of the notes of value during the manual filling and the direction of removal during the automatic removal of the notes of value in the device are unidirectional. With respect to the cash cassette itself, however, the manual feeding during filling and the automatic removal take place in opposite directions. With respect to the orientation of the cash cassette during filling, a removal may take place in upward direction by means of which the L-folded notes of value can be removed much easier than in the case of a removal in downward direction since the notes of value have to be pulled only around their folded edge.

To make this possible, the opening for the manual filling and the opening for the automatic removal may be arranged at the same side of the cash cassette.

Further, the cover of the cash cassette may be designed so that the notes of value, after rotation of the cash cassette, are kept in the receiving area by means of the cover and may stand with one of their edges on the cover of the cash cassette. Accordingly, the cover may have a smooth support surface on which the notes of value can stand and on which, while standing on their edges, they can be biased during removal in the direction of the opening for the automatic removal by means of a press-on carriage.

A check may be carried out, after filling but before closing the cover to determine whether all notes of value have a predetermined orientation and that no L-folded notes of value are present. This check can, for example, take place manually by the person filling the cash cassette or alternatively also automatically. For example optical sensors, such as a camera, which detect the L-folded notes of value may be provided for the automatic check.

If it is determined that the orientation of notes of value differs from the predetermined orientation, the orientation of these notes of value may be corrected such that all notes of value have the predetermined orientation. In particular, all L-folded notes of value are corrected.

The invention also relates to a cash cassette comprising a first opening for manual feeding of notes of value and a second opening for automatic removal of notes of value. The cash cassette may comprise a cover by means of which the first opening is closable. The cash cassette may be designed to be insertable into a device for handling notes of value, for example an automated teller machine or an automatic cash safe, with the cover directed downwards. When the cash cassette is oriented in this way, i.e. with the cover being arranged at the bottom, notes of value are automatically removable from the cash cassette through the second opening by means of a separating module of the device for handling notes of value. If the cash cassette was inserted into the device for handling notes of value with the cover directed upwards, notes of value would not be automatically removable from the cash cassette through the second opening by means of a separating module of the device for handling notes of value.

The invention also relates to a device for handling notes of value, such as an automated teller machine, an automatic cash register system or an automatic cash safe that has a receiving compartment for receiving cash cassettes. In this receiving compartment, a cash cassette is inserted so that its cover for closing the opening for the manual filling is directed downwards. Further, the device may comprise a separating module by means of which notes of value can be taken from the cash cassette via the second opening of the cash cassette.

Further features and advantages of the invention result from the following description which explains the invention in more detail on the basis of embodiments in connection with the enclosed Figures.

DETAILED DESCRIPTION

Figure 1:
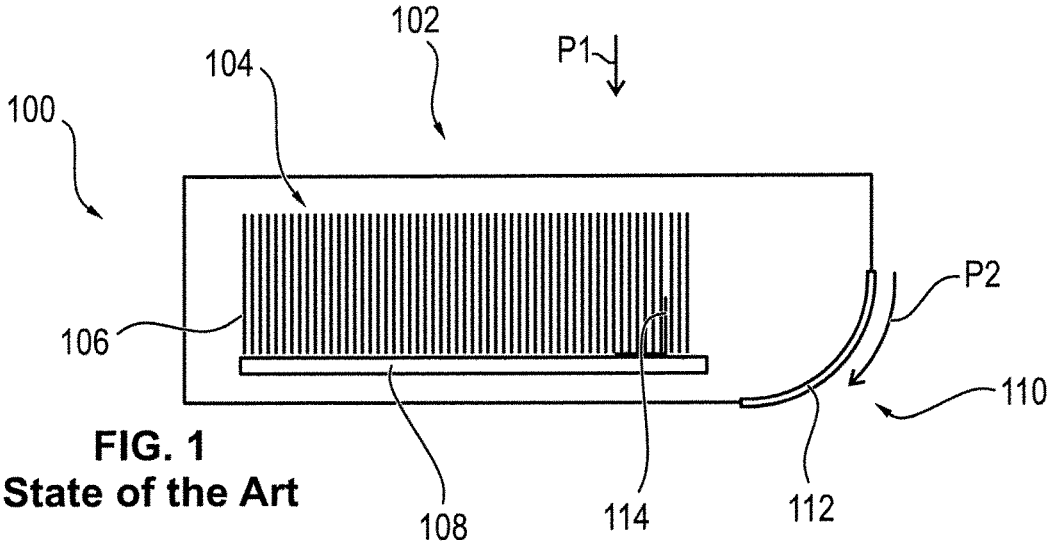
FIG. 1 shows a schematic illustration of a cash cassette of the prior art.
Figure 2:
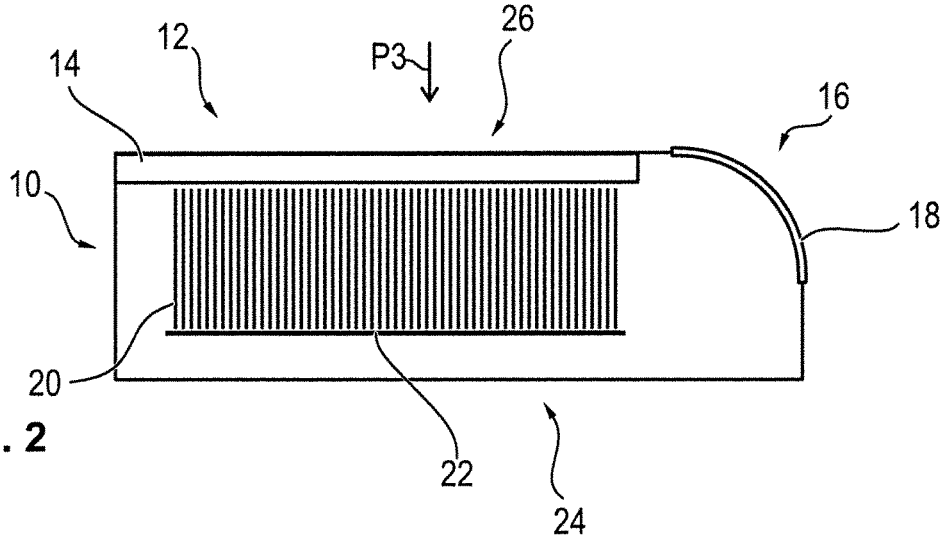
FIG. 2 shows a schematic illustration of an inventive cash cassette in a first orientation.

In FIG. 2, a schematic illustration of a cash cassette in a first orientation is shown, which the cash cassette 10 assumes in a cash center in particular during the manual filling of the cash cassette 10 with notes of value.

The cash cassette 10 has a first opening 12 for the manual feeding of notes of value, and the first opening 12 is closable by a cover 14. Further, a second opening 16 for the automatic removal of notes of value is provided, and the second opening 16 being closable by a movable shutter 18.

When the cash cassette 10 is filled, at first the cover 14 is opened and thereafter the notes of value 20 are fed to the receiving area of the cash cassette 10 from above in the direction of the arrow P3. Here, the notes of value 20 received in the receiving area stand with one of their edges on a bottom element 22.

If the person filling the cash cassette determines during this filling that L-folded notes of value are at the top of the value note stack, i.e. on the side facing the opening 12 and readily visible by the operator, then the operator corrects these notes of value accordingly so that any L-folding is eliminated.

Thereafter, the cover 14 is closed so that the first opening 12 is likewise closed.

Figure 3:
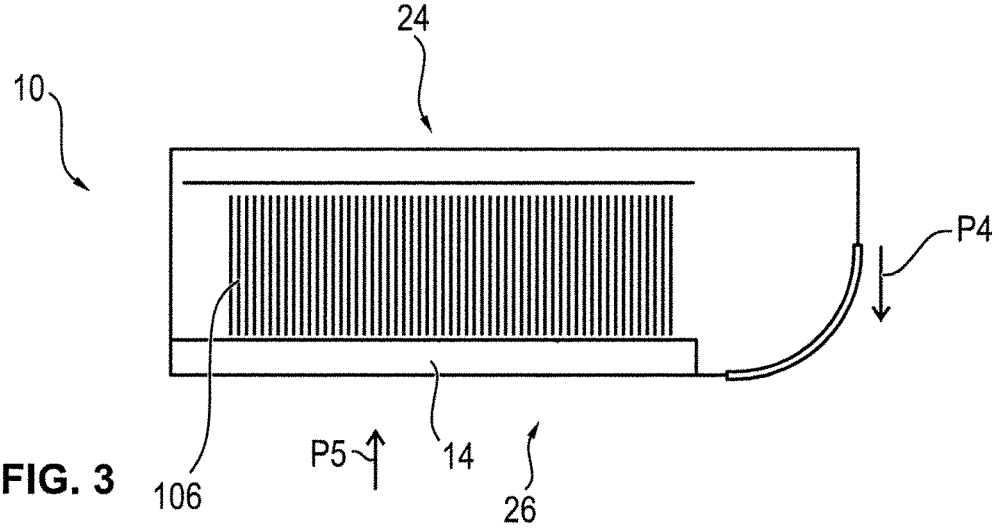
FIG. 3 shows a schematic illustration of the cash cassette according to FIG. 2 in a second orientation.

Before the cash cassette 10 is inserted into a device for handling notes of value, such as an automated teller machine, an automatic cash register system or an automatic cash safe, it is rotated by 180° so that the underside 24 is arranged at the top and the upper side 26 is then arranged at the bottom. This rotated orientation is shown in FIG. 3. The cash cassette 10 is inserted in this rotated orientation into the device for handling notes of value. During insertion, the shutter 18 is opened so that the second opening 16 is opened and notes of value can automatically be taken out of the cash cassette 10 by means of a separating module. Here, the notes of value, as in all conventional automated teller machines, are removed downwards in the direction of the arrow P4 so that, in absolute terms, the feeding and the removal of the notes of value take place in the same direction P3, P4. With respect to the cash cassette 10 itself, however, the manual feeding and the automatic removal take place in different directions, as this is indicated by the arrows P4 and P5, P5 showing the original feeding direction P3 when the cash cassette 10 is rotated accordingly.

By turning over the cash cassette before it is inserted into the device for handling notes of value, it is achieved that now the notes of value 20 stand on those edges which were arranged at the top during feeding and thus are visible for the operator. Thus, it cannot happen that L-folded notes of value are present on the side standing on the bottom element. L-folded notes of value may only be present on the upper side in the orientation shown in FIG. 3. This, however, is not critical since problems in the removal of L-folded notes of value usually only occur when this L-folding is present at the bottom so that the adjacent notes of value 20 of the value note stack stand on the folded part.

In addition, in the case of any L-foldings present at the top, the notes of value only have to be guided around this folded edge when removed in downward direction, which much more rarely results in problems than the downward removal in the case of L-folded notes of value present at the bottom, as this would be the case without the rotation of the cash cassette.

Thus, it is achieved that the occurrence of problems due to L-folded notes of value is minimized and the cash cassette 10 can nevertheless be inserted into known automated teller machines and other devices for handling notes of value in which a downward removal takes place.

Figure 4:
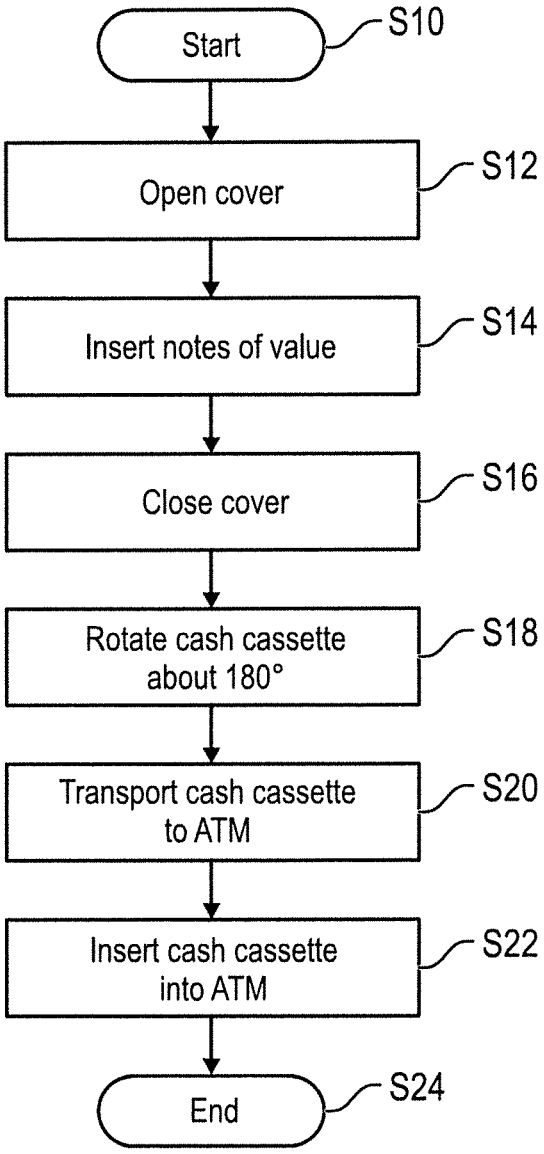
FIG. 4 shows a flow chart of a method for feeding notes of value to a device for handling notes of value.

In FIG. 4, a flow chart of the method, as described briefly above, for feeding notes of value to a device for handling notes of value is shown.

After the method has been started in step S10, the cover is opened in step S12, before then the notes of value are fed to the cash cassette 10 from above in the direction of the arrow P3 in step S14.

After all notes of value 20 to be fed to the cash cassette 10 have been fed, the cover 16 is closed in step S16 and the cash cassette is rotated by 180° in step S18 so that it is upside down. In this case, the received notes of value in particular stand on the cover 14 itself which has a corresponding smooth surface.

Thereafter, the cash cassette 10 is transported in step S20 to the automated teller machine or another device for handling notes of value in which it is to be inserted.

In an alternative method, the steps S18 and S20 can also be interchanged, i.e. the cash cassette 10 can first be transported to the device for handling notes of value and then be rotated accordingly on-site before it is inserted into the device.

In step S22, the cash cassette 10 is inserted into the device for handling notes of value before the method is terminated in step S24.

After all notes of value 20 have been removed from the cash cassette 10 or when a maintenance is due, the cash cassette 10 is again removed from the device for handling notes of value and is transported back into the cash center. Before the cover 14 is again opened and new notes of value 20 are fed or a maintenance is carried out, the cash cassette 10 is again rotated such that the side arranged at the bottom before is now arranged at the top and vice versa.

LIST OF REFERENCE SIGNS

10, 100 cash cassette
12, 16, 102, 110 opening
14 cover
18, 112 shutter
20, 106 note of value
22, 108 bottom unit
24 underside
26 upper side
104 receiving area
114 L-folded note of value
P1 to P5 direction
S10 to S24 method step

What is claimed is:

1. A method for feeding notes of value to a device for handling notes of value, comprising manually feeding the notes of value to a cash cassette via an opening in the cash cassette during filling;

moving a cover of the cash cassette for closing the opening;

rotating the cash cassette by 180° into a rotated orientation so that a side that was arranged at the bottom during the filling of the cash cassette is arranged at the top; and inserting the cash cassette into the device for handling notes of value in the rotated orientation.

2. The method of claim 1, wherein the notes of value are fed from above in a substantially vertical direction during the manual filling.

3. The method of claim 1, wherein the cash cassette is manually filled in a cash center.

4. The method of claim 3, wherein the step of rotating the cash cassette is carried out in the cash center so that the side that was arranged at the bottom during the filling of the cash cassette is arranged at the top, and the method further comprising transporting the cash cassette to the device for handling notes of value in the rotated orientation.

5. The method of claim 3, further comprising transporting the cash cassette from the cash center to the device for handling notes of value in the orientation in which the cash cassette was filled, and rotating the cash cassette on-site at the device before insertion into the device.

6. The method of claim 1, further comprising using a separating module of the device for handling notes of value so that the notes of value are removed automatically from the cash cassette via another opening of the cash cassette by the separating module of the device.

7. The method of claim 6, wherein the notes of value are removed downwards from the cash cassette.

8. The method of claim 7, wherein, a feeding direction of the notes of value during the manual filling and a removal direction during the automatic removal of the notes of value have the same direction in the device.

9. The method of claim 7, wherein a feeding direction of the notes of value during the manual filling and a removal direction during the automatic removal of the notes of value in the device have opposite directions with respect to the cash cassette.

10. The method of claim 6, wherein the opening for the manual filling and the opening for the automatic removal are provided on the same side of the cash cassette.

11. The method of claim 1, further comprising holding the notes of value, in the receiving area of the cash cassette via the cover after rotation of the cash cassette.

12. The method of claim 11, wherein the notes of value stand on the cover after rotation of the cash cassette.

13. The method of claim 1, further comprising checking, after filling and before closing the cover, to determine whether all of the notes of value have a predetermined orientation and that no L-folded notes of value are present.

14. The method of claim 13, further comprising correcting the orientation of any of the notes of value that differ from the predetermined orientation so that all of the notes of value have the predetermined orientation.

* * * * *